US007091999B2

(12) United States Patent
Okuchi et al.

(10) Patent No.: US 7,091,999 B2
(45) Date of Patent: Aug. 15, 2006

(54) THERMAL PRINTING APPARATUS AND PRINTING METHOD

(75) Inventors: Hiroyuki Okuchi, Nagoya (JP); Megumi Matsutani, Okazaki (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 170 days.

(21) Appl. No.: 10/919,446

(22) Filed: Aug. 17, 2004

(65) Prior Publication Data

US 2005/0068403 A1 Mar. 31, 2005

(30) Foreign Application Priority Data

Sep. 26, 2003 (JP) ..... 2003-335741

(51) Int. Cl.
*B41J 2/365* (2006.01)

(52) U.S. Cl. ..... 347/194

(58) Field of Classification Search ..... 347/194, 347/14, 17, 188, 186, 6, 10; 400/124.04, 400/279, 120.14
See application file for complete search history.

(56) References Cited

U.S. PATENT DOCUMENTS 4,877,344 A 10/1989 Watahiki et al.
5,312,193 A * 5/1994 Kringe et al. ..... 400/124.04
5,331,340 A 7/1994 Sukigara
5,524,993 A * 6/1996 Durst ..... 400/279
5,690,437 A * 11/1997 Yanagisawa et al. .. 400/120.14
5,741,079 A 4/1998 Hayama et al.
5,963,241 A * 10/1999 Higa et al. ..... 347/186
5,986,684 A * 11/1999 Ohashi ..... 347/194
6,042,284 A 3/2000 Yanagisawa et al.
6,297,841 B1 10/2001 Takeda
6,377,290 B1 4/2002 Amiya et al.
6,601,941 B1 8/2003 Jones et al.
6,655,772 B1 * 12/2003 Danzuka et al. ..... 347/14

FOREIGN PATENT DOCUMENTS

JP U 64-20340 2/1989

* cited by examiner

*Primary Examiner*—K. Feggins
(74) *Attorney, Agent, or Firm*—Oliff & Berridge, PLC

(57) ABSTRACT

A printing apparatus including a thermal head, a measurement device that measures a temperature of the thermal head and a controller. The controller controls a printing speed on the basis of the measured temperature as measured by the measurement device, determines whether the measured temperature of the thermal head is rising or dropping, compares a preliminarily determined first threshold value with the measured temperature when the temperature is rising, compares a preliminarily determined second threshold value with the measured temperature when the temperature is dropping, controls printing by reducing the printing speed when the measured temperature is greater than the first threshold value, and controls printing by raising the printing speed when the measured temperature is less than the second threshold value.

31 Claims, 11 Drawing Sheets

FIG. 7

STANDARD PARAMETER

| RANGE | DUTY (%) |
|---|---|
| 5°C AND UNDER | 54% |
| 5<T≦10 | 50% |
| 10<T≦15 | 46% |
| 15<T≦20 | 42% |
| 20<T≦25 | 38% |
| 25<T≦30 | 35% |
| 30<T≦35 | 32% |
| 35<T≦38 | 31% |
| 38<T≦41 | 30% |
| 41<T≦44 | 30% |
| 44<T≦47 | 29% |
| 47<T≦50 | 29% |
| 50<T≦53 | 29% |
| 53<T≦56 | 28% |
| 56<T≦59 | 28% |
| 59<T≦62 | 28% |
| 62<T≦65 | 28% |
| 65<T≦68 | 28% |
| 68<T≦71 | 28% |
| 71<T≦74 | 28% |
| 74<T≦77 | 28% |
| 77<T≦80 | 28% |

FIG. 8

PARAMETER A

| RANGE | DUTY (%) |
|---|---|
| 5°C AND UNDER | 49% |
| 5<T≦10 | 45% |
| 10<T≦15 | 41% |
| 15<T≦20 | 37% |
| 20<T≦25 | 32% |
| 25<T≦30 | 28% |
| 30<T≦35 | 25% |
| 35<T≦38 | 24% |
| 38<T≦41 | 23% |
| 41<T≦44 | 23% |
| 44<T≦47 | 23% |
| 47<T≦50 | 23% |
| 50<T≦53 | 22% |
| 53<T≦56 | 22% |
| 56<T≦59 | 22% |
| 59<T≦62 | 22% |
| 62<T≦65 | 22% |
| 65<T≦68 | 22% |
| 68<T≦71 | 22% |
| 71<T≦74 | 22% |
| 74<T≦77 | 22% |
| 77<T≦80 | 22% |

FIG. 9

PARAMETER B

| RANGE | DUTY (%) |
|---|---|
| 5°C AND UNDER | 51% |
| 5<T≦10 | 48% |
| 10<T≦15 | 44% |
| 15<T≦20 | 39% |
| 20<T≦25 | 35% |
| 25<T≦30 | 31% |
| 30<T≦35 | 28% |
| 35<T≦38 | 27% |
| 38<T≦41 | 27% |
| 41<T≦44 | 26% |
| 44<T≦47 | 26% |
| 47<T≦50 | 26% |
| 50<T≦53 | 25% |
| 53<T≦56 | 25% |
| 56<T≦59 | 25% |
| 59<T≦62 | 25% |
| 62<T≦65 | 25% |
| 65<T≦68 | 25% |
| 68<T≦71 | 25% |
| 71<T≦74 | 25% |
| 74<T≦77 | 25% |
| 77<T≦80 | 25% |

FIG. 10

PARAMETER C

| RANGE | DUTY (%) |
|---|---|
| 5°C AND UNDER | 64% |
| 5<T≦10 | 62% |
| 10<T≦15 | 57% |
| 15<T≦20 | 52% |
| 20<T≦25 | 47% |
| 25<T≦30 | 43% |
| 30<T≦35 | 36% |
| 35<T≦38 | 34% |
| 38<T≦41 | 33% |
| 41<T≦44 | 32% |
| 44<T≦47 | 31% |
| 47<T≦50 | 31% |
| 50<T≦53 | 30% |
| 53<T≦56 | 29% |
| 56<T≦59 | 29% |
| 59<T≦62 | 29% |
| 62<T≦65 | 28% |
| 65<T≦68 | 28% |
| 68<T≦71 | 28% |
| 71<T≦74 | 28% |
| 74<T≦77 | 28% |
| 77<T≦80 | 28% |

FIG. 11

PARAMETER D

| RANGE | DUTY (%) |
|---|---|
| 5°C AND UNDER | 59% |
| 5<T≦10 | 56% |
| 10<T≦15 | 52% |
| 15<T≦20 | 47% |
| 20<T≦25 | 43% |
| 25<T≦30 | 39% |
| 30<T≦35 | 34% |
| 35<T≦38 | 32% |
| 38<T≦41 | 31% |
| 41<T≦44 | 31% |
| 44<T≦47 | 30% |
| 47<T≦50 | 30% |
| 50<T≦53 | 29% |
| 53<T≦56 | 29% |
| 56<T≦59 | 29% |
| 59<T≦62 | 28% |
| 62<T≦65 | 28% |
| 65<T≦68 | 28% |
| 68<T≦71 | 28% |
| 71<T≦74 | 28% |
| 74<T≦77 | 28% |
| 77<T≦80 | 28% |

THERMAL PRINTING APPARATUS AND PRINTING METHOD

CROSS-REFERENCE TO RELATED APPLICATION

This application claims priority from JP 2003-335741, filed Sep. 26, 2003, the entirety of which is incorporated by reference thereto.

1. Field of Invention

The invention relates to a thermal type printing apparatus and a printing method.

2. Description of Related Art

In the related art, there are thermal type printing apparatuses that perform by applying a voltage to heating elements of a thermal head so that a temperature of the thermal head is increased when the printing apparatus is continuously used. However, when the temperature becomes too high, no heat transfer can be performed since an ink ribbon is torn off prior to heat transfer and setting to an image receiving layer. As a result, the quality of printing is degraded. To prevent this problem, a temperature sensor is provided to detect the temperature of the thermal head. When a specified temperature is exceeded, adjustments are performed to change pulse widths of the applied voltage or to change printing speeds.

For example, Japanese Utility Model Application Laid-Open Publication No. 64-20340 (1989) discloses a thermal head driving apparatus including a print control circuit in which printing speeds are changed in response to outputs of a temperature sensor that detects changes in the temperature of a thermal head.

SUMMARY OF THE INVENTION

In the thermal head driving apparatus described above, a printing speed is reduced when an upper limit temperature is detected by the temperature sensor and raised when an optimal temperature is detected. However, because only one switching temperature (threshold) was provided for the printing speed a high printing speed and a low printing speed were alternately switched in close proximity to the switching temperature and affecting affect qualities of printing.

One object of the invention is to provide a printing apparatus in which temperature control in proximity of a boundary of a temperature threshold is not frequently switched.

To achieve the above objects and/or other objects, according to an exemplary aspect of the invention, there is provided a printing apparatus including a thermal head, a measurement device that measures a temperature of the thermal head, and a controller that controls the following: a printing speed on the basis of the measured temperature as measured by the measurement device, determines whether the measured temperature of the thermal head is rising or dropping, compares a preliminarily determined first threshold value with the measured temperature when the temperature is rising, compares a preliminarily determined second threshold value with the measured temperature when the temperature is dropping, controls printing by reducing the printing speed when the measured temperature is greater than the first threshold value, and controls printing by raising the printing speed when the measured temperature is less than the second threshold value.

According to this structure, when threshold temperatures are respectively determined for situations in which the temperature is rising or falling, the printing speeds will not be frequently switched when the thermal head temperatures proximate to the threshold temperatures are detected so as to reduce constant shifting.

BRIEF DESCRIPTION OF THE DRAWINGS

Objects, features and advantages of the invention will become more apparent from reading the following description of exemplary embodiments taken in connection with the accompanying drawings in which:

FIG. 7 is a schematic view of a control parameter table according to the exemplary embodiment of the invention;

FIG. 8 is a schematic view of a control parameter table when the temperature is rising according to the exemplary embodiment of the invention;

FIG. 9 is a schematic view of a control parameter table when the temperature is rising according to another exemplary embodiment of the invention;

FIG. 10 is a schematic view of a control parameter table when the temperature is dropping according to an exemplary embodiment of the invention; and FIG. 11 is a schematic view of a control parameter table when the temperature is dropping according to another exemplary embodiment of the invention.

DETAILED DESCRIPTION OF EXEMPLARY EMBODIMENTS

Figure 1:
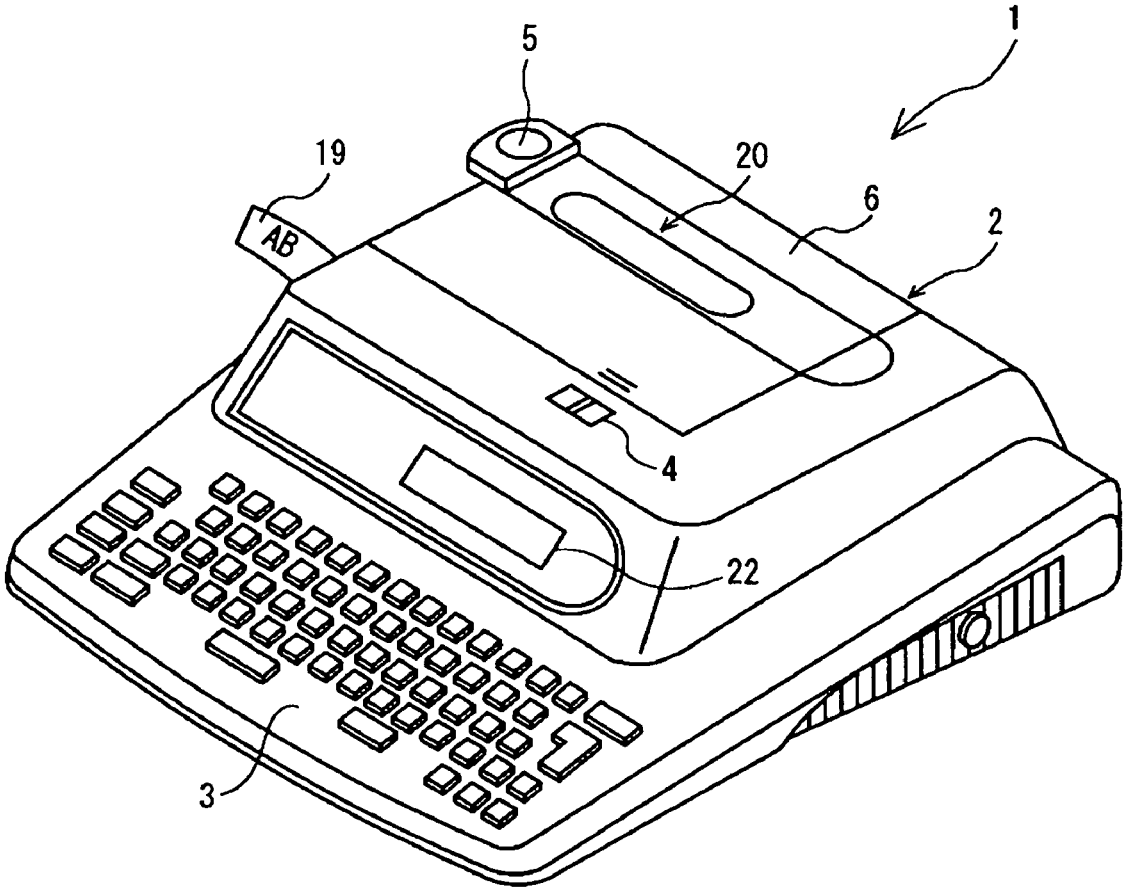
FIG. 1 is a perspective view of a tape printing apparatus according to an exemplary embodiment of the invention.
Figure 2:
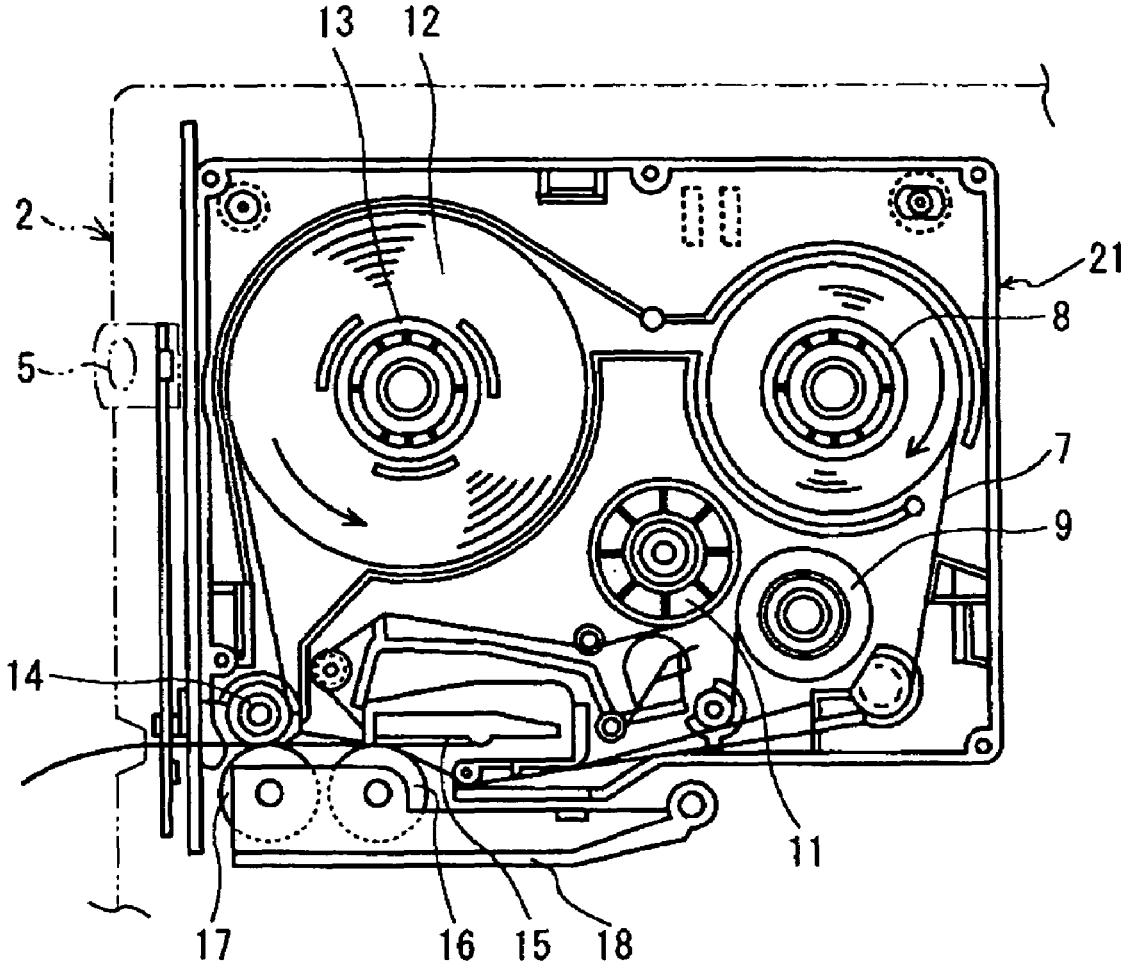
FIG. 2 is a partially enlarged sectional view of an interior of a main body frame of the tape printing apparatus according to the exemplary embodiment of the invention.

Exemplary embodiments of a tape printing apparatus, which is an exemplary embodiment of a printing apparatus of the invention will be described with reference to the accompanying drawings. First, a schematic structure of a tape printing apparatus 1 according to the exemplary embodiment will be described with reference to FIGS. 1 and 2. FIG. 1 is a perspective view of the tape printing apparatus 1 according to an exemplary embodiment. FIG. 2 is a partially enlarged sectional view of an interior of a main body frame of the tape printing apparatus 1 according to an exemplary embodiment.

As shown in FIG. 1, the tape printing apparatus 1 includes, a main body frame 2, a keyboard 3 disposed at a front portion of the main body frame 2, a print mechanism 20 disposed at a rear portion within the main body frame 2, a liquid crystal display (hereinafter referred to as LCD) 22 provided immediately behind the keyboard 3 and capable of displaying characters, symbols and the like, and a cover frame 6 covering a top surface of the main body frame 2. A release button 4 that opens the cover frame 6 to insert and eject a tape cassette 21 (see FIG. 2), that is mounted to the print mechanism 20 that is provided at the top surface of the main body frame 2, and a cutting operating button 5 that manually cuts a printing tape 19 is provided at a side end of the cover frame 6 (left side end in FIG. 1).

The keyboard 3 includes, among others, character keys for inputting alphabets, numerals, symbols and the like, a space key, a return key, a linefeed key, cursor moving keys that move a cursor key up, down, right or left, a size setting key that arbitrarily sets sizes of characters to be printed, character size keys that set the arbitrary character sizes to dot sizes, e.g., 16, 24, 32, 48, 64 and 96, an automatic setting key that automatically sets the character size to be printed in accordance with a tape width or a number of lines of the printing tape 19, a print key that instructs printing, an execution key that terminates various setting processes, and a power key that switches the power ON/OFF.

Next, the print mechanism 20 will be described with reference to FIG. 2. As shown in FIG. 2, the tape cassette 21 is detachably mounted to the print mechanism 20. In the tape cassette 21, there are disposed a tape spool 8 around which a transparent laminated film 7 is wound, an ink ribbon 9 arranged in that ink, which is melted through heating, is applied onto a base film, a take-up spool 11 that takes up the ink ribbon 9, a supply spool 13 arranged in that a double-sided adhesive tape 12 having the same width as the laminated film 7 is wound up with a separator of the double-sided adhesive tape 12 being directed outward, and a joining roller 14 that joins the laminated film 7 and the double-sided adhesive tape 12. In this respect, the double-sided adhesive tape 12 is arranged with adhesive layers formed on opposing surfaces of the base tape. Additionally, a separator is adhered to one of the adhesive layers.

A thermal head 15 is provided at a location where the laminated film 7 and the ink ribbon 9 overlap. A platen roller 16 that presses the laminated film 7 and the ink ribbon 9 against the thermal head 15 and a feeding roller 17 that presses the laminated film 7 and the double-sided adhesive tape 12 against the joining roller 14 that creates the printing tape 19 are pivotally supported in a freely rotatable manner by a supporting member 18 that is pivotally attached to the main body frame 2. A group of heating elements (not shown) including, e.g., 128 heating elements, is provided at the thermal head 15 such that the group of heating elements are aligned and extend in a vertical direction (direction perpendicular to the plane of the drawing sheet of FIG. 2).

Accordingly, as the joining roller 14 and the take-up spool 11 are synchronously driven in specified rotating directions by driving a tape feeding motor 47 (see FIG. 3), the group of heating elements conduct electricity and only specified heating elements generate heat to heat the ink ribbon 9. By heating the ink ribbon 9, the ink applied on the ink ribbon 9 is melted and thermally transferred onto the laminated film 7. As characters, symbols, barcodes and the like, are printed onto the laminated film 7 through a plurality of dot strings, the laminated film 7 is joined with the double-sided adhesive tape 12 and further fed as the printing tape 19 in a tape feeding direction A to outside of the main body frame 2 (left-hand side in FIG. 1) as illustrated in FIGS. 1 and 2. Japanese Patent Laid-Open Publication No. 2-106555 (1990) provides details of the print mechanism 20.

Figure 3:
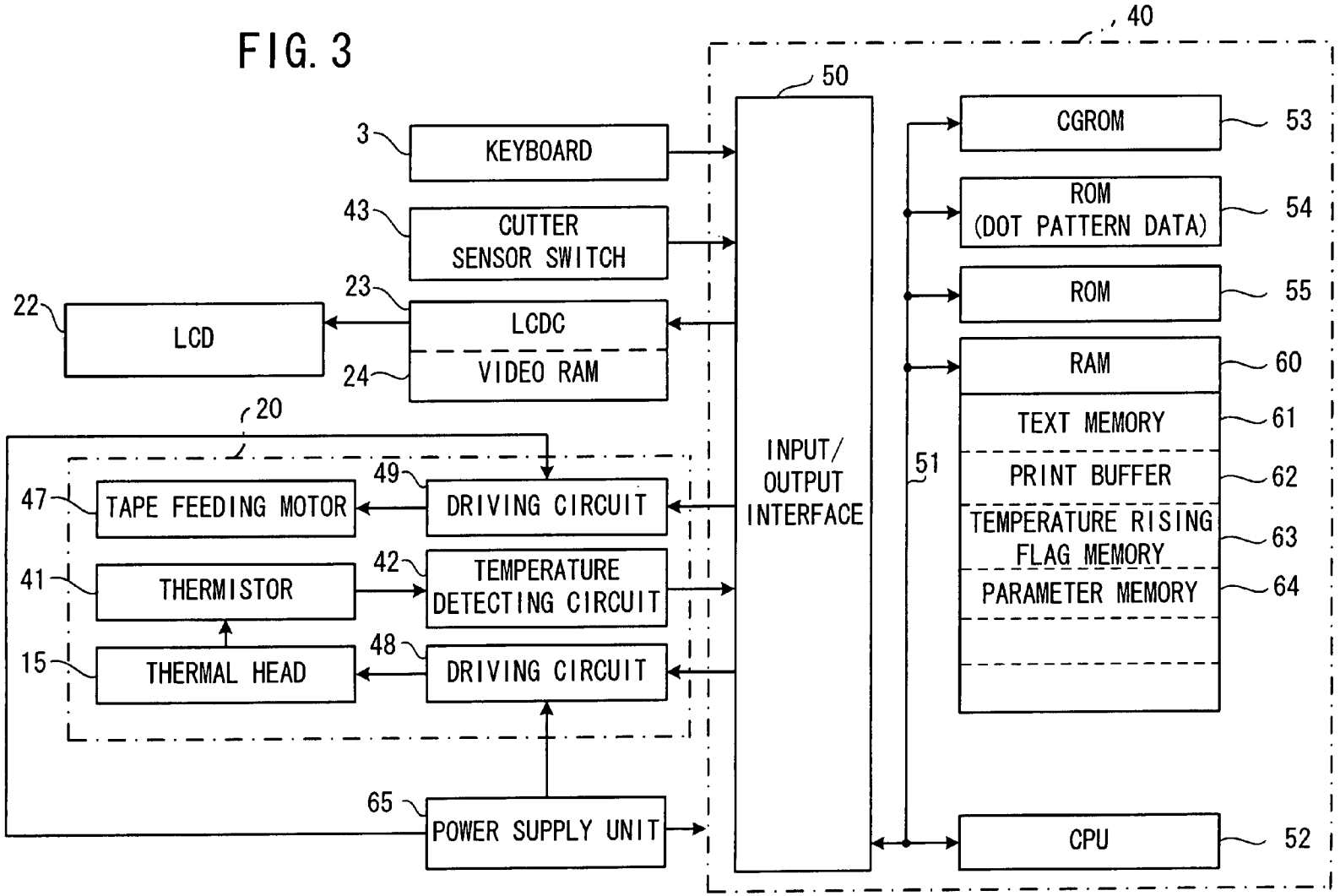
FIG. 3 is a block diagram illustrating electric arrangements of the tape printing apparatus according to the exemplary embodiment of the invention.

Hardware configurations of the tape printing apparatus 1 according to the exemplary embodiment will be described with reference to FIG. 3. FIG. 3 is a block diagram of a hardware configuration of the tape printing apparatus 1 of the exemplary embodiment. As shown in FIG. 3, a controller 40 includes a CPU 52 that controls respective devices of the tape printing apparatus 1, and an input/output interface 50, a CGROM 53, ROMs 54, 55 and a RAM 60 that are connected to the CPU 52 through a data bus 51.

The keyboard 3, a cutter sensor switch 43, a display controller (hereinafter referred to as LCDC) 23 including a video RAM 24 that outputs display data on the LCD 22, a driving circuit 48 that drives the thermal head 15, a temperature detecting circuit 42 that receives outputs of a thermistor 41, which is a temperature sensor provided on the thermal head 15, and sending them out to the CPU 52, and a driving circuit 49 that drives the tape feeding motor 47 are respectively connected to the input/output interface 50.

The ROM (dot pattern data) 54 stores therein dot pattern data used to print characters such as letters, symbols and the like upon being classified into respective typefaces such as gothic type typeface, a Mincho typeface and the like to correspond to code data of printing character sizes for each typeface, e.g., (dot sizes of 16, 24, 32, 48, 64 and 96). Graphic pattern data used to print graphic images including grayscale expressions are also stored in the ROM 54.

The ROM 55 stores therein, among others, a display drive control program that controls the LCDC 23 in correspondence with code data of printing characters such as letters or numbers that have been input through the keyboard 3, a print drive control program that controls the thermal head 15 or the tape feeding motor 47 upon reading data of a print buffer 62, and a parameter table defining duty ratios that determine print energy that drives the thermal head 15 (see FIGS. 7 to 11).

The RAM 60 is provided with, among others, a text memory 61, a print buffer 62, a temperature rising flag memory 63, and a parameter memory 64. The text memory 61 stores therein document data that have been input through the keyboard 3. The print buffer 62 stores therein a plurality of printing dot patterns such as letters or symbols as print data. When the temperature of the thermal head is rising, 1 is stored into the temperature rising flag memory 63 while 0 is stored when the temperature is dropping. A type of the parameter table of the presently used print energy is stored in the parameter memory 64.

A power supply unit 65 is connected to the driving circuits 48, 49, the controller 40 and the LCDC 23. Power is supplied from the power supply unit 65 to the controller 40, the print mechanism 20 and the entire tape printing apparatus 1.

Printing operation of the tape printing apparatus 1 of the above structure will be described. When characters are input through the keyboard 3, the characters are stored in the text memory 61 of the RAM 60, and dot pattern data of the input text are created by using the dot pattern data of the ROM 54 in accordance with a control program stored in the ROM 55 whereupon the data are stored in the print buffer 62. The thermal head 15 is then driven via the driving circuit 48 performing printing preparations. Upon completion of printing preparations, dot pattern data are read out from the print buffer 62 and sent out to the driving circuit 48 line by line to perform printing.

Figure 4:
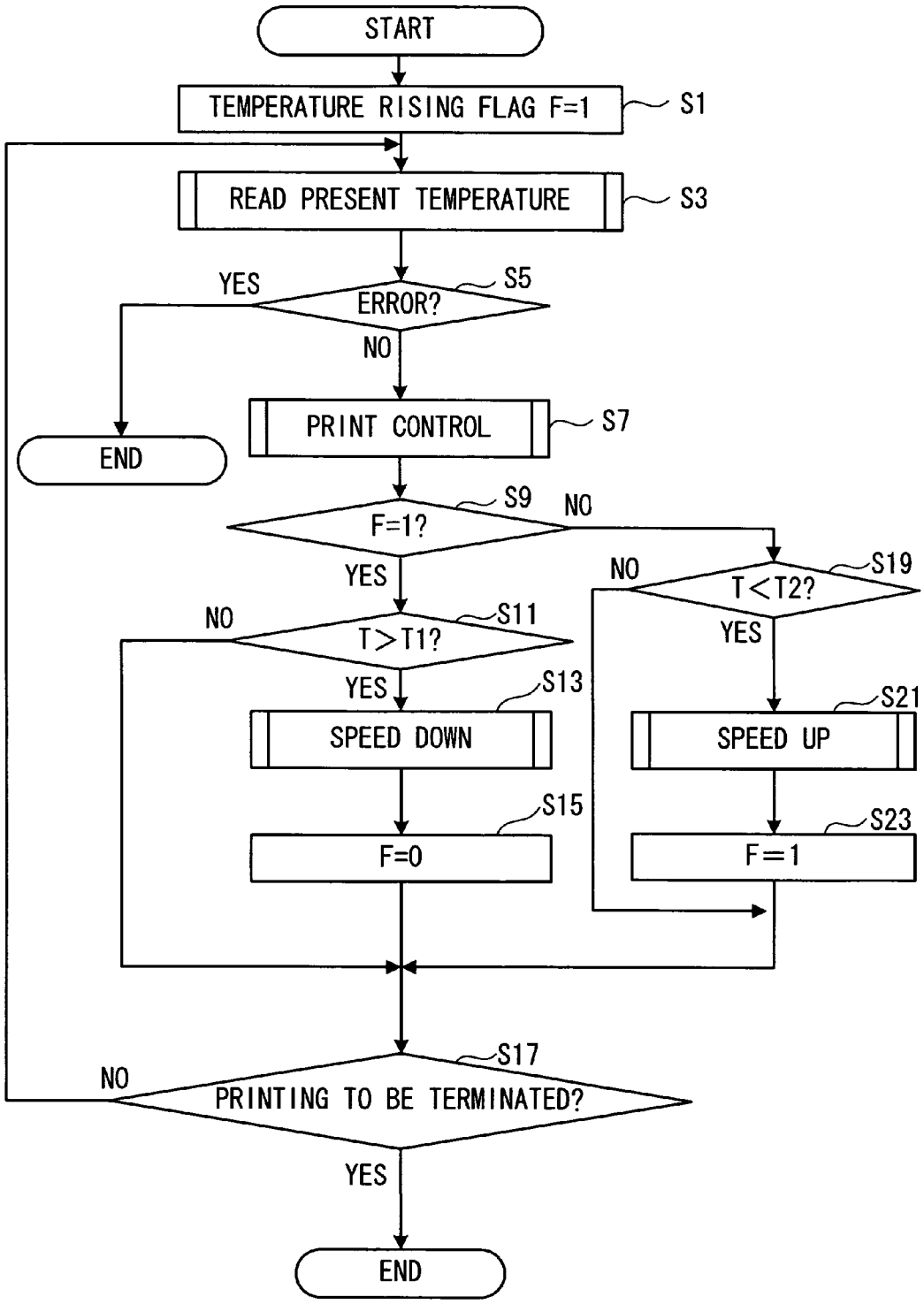
FIG. 4 is a flowchart that illustrates printing speed control according to the exemplary embodiment of the invention.
Figure 5:
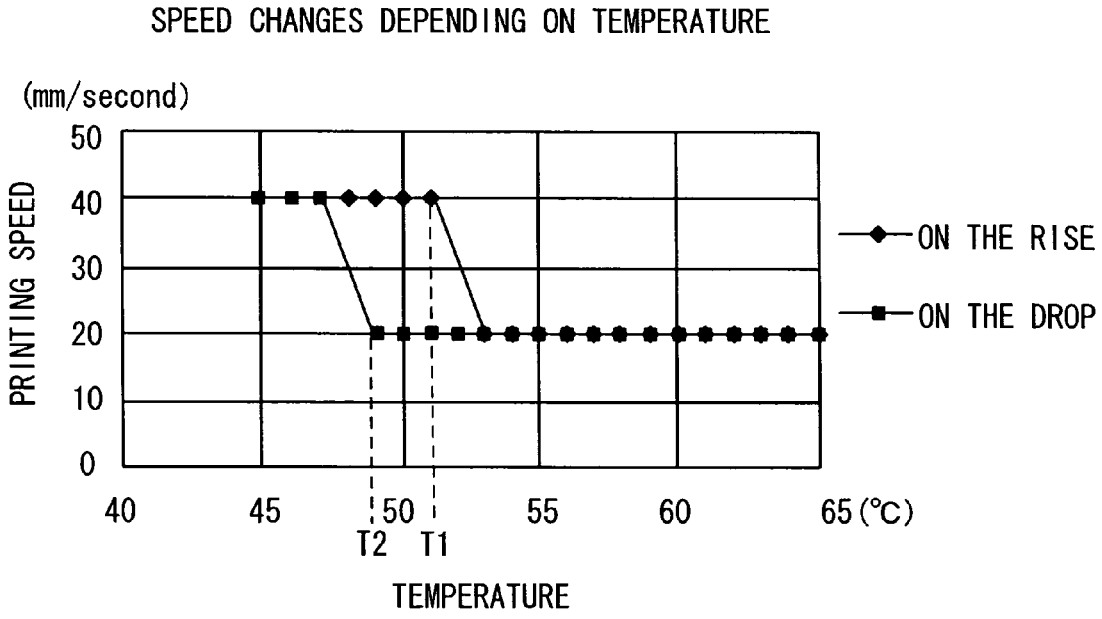
FIG. 5 is a graph that illustrates printing speed and temperature when the printing speed control has been performed according to the exemplary embodiment of the invention.

Printing speed control of the tape printing apparatus 1 will be described with reference to FIGS. 4 and 5. FIG. 4 is a flowchart that illustrates printing speed control. FIG. 5 is a graph illustrating printing speed and temperature when the printing speed control is executed. As initial settings, 1 is set as the temperature rising flag F (S1). As for the temperature rising flag F, 1 is set if the temperature of the thermal head 15 is rising and 0 is set if the temperature of the thermal head 15 is dropping. After switching the power ON, the temperature of the thermal head 15 is gradually raised through applied voltage so that 1 is set as the initial value. A temperature T of the thermal head 15 read by the thermistor 41 is then obtained via the temperature detecting circuit 42 (S3). Next, whether an error has occurred during temperature detection (S5) is determined. In the presence of an error (S5: YES), printing processes are terminated. If no error is present (S5: NO), normal print control corresponding to one line is performed to execute printing (S7).

Next, whether the temperature rising flag F is 1 is determined. That is, whether the temperature of the thermal head 15 is presently rising (S9). If F=1 (S9: YES), whether the present temperature T of the thermal head 15 as read in step S3 has exceeded a first threshold T1 (S11) is determined. The first threshold T1 is a printing speed switching temperature when the temperature T is rising, and is a set temperature, e.g., 53 degrees.

If the present temperature T1 has not exceeded the first threshold T1 (S11: NO), whether printing is to be terminated is determined (S17). If printing is not to be terminated yet (S17: NO), operation returns to step S3 to read the temperature of the thermal head 15. If the present temperature T has exceeded the first threshold T1 (S11: YES), the driving circuit 49 is controlled to change the applying period of pulse with respect to the heating elements of the thermal head 15 and to reduce the printing speed (S13). After execution of printing speed reducing control, a time to start the next printing will become longer, the time of cooling of the thermal head 15 will become longer, and the temperature T of the thermal head 15 falls so that the temperature rising flag F is set to 0 (S15). Then, whether printing is to be terminated (S17) is determined. If printing is not to be terminated yet (S17: NO), the program returns to step S3 to read the temperature of the thermal head 15 again.

Next, the following and later routines describe when temperature T is dropping (S9: NO). First, whether the present temperature T of the thermal head 15 as read in step S3 has fallen below a second threshold T2 (S19) is determined. The second threshold T2 is a printing speed switching temperature when the temperature is dropping, and is a set temperature that is lower than the first threshold T1, e.g., 48 degrees. In this manner, it is possible to individually set suitable temperatures for the thresholds T1 and T2 such that T1>T2 is satisfied or alternatively, to set one threshold and then to set upper and lower ranges from this threshold to obtain two thresholds. For instance, the threshold may be defined as 50 degrees and by setting an upper and lower range to 3 degrees, the first threshold T1 may be 53 degrees while the second threshold T2 may be 47 degrees.

If the temperature T has just started dropping and the present temperature T has not fallen below the second threshold T2 yet (S19: NO), whether printing is to be terminated (S17) is determined. If printing is not to be terminated yet (S17: NO), the program returns to step S3 to read the temperature T of the thermal head 15 again.

If the temperature is dropping (S9: NO) and the present temperature T has fallen below the second threshold T2 (S19: YES), control is performed to change the applied period of pulse with respect to the heating elements of the thermal head 15 and to increase the printing speed (S21). After execution of such printing speed increasing control, a time to start the next printing will become shorter, the time of cooling of the thermal head 15 will become shorter, and the temperature T of the thermal head 15 rises so that the temperature rising flag F is set to 1 (S23). Then, whether printing is to be terminated (S17) is determined. If printing is not to be terminated yet (S17: NO), the program returns to step S3 to read the temperature T of the thermal head 15 again.

The above processes are then repeated in which the temperature T of the thermal head 15 is read and compared with the threshold temperatures T1, T2 that meet rising and dropping vectors of temperature (temperature rising flag) are compared with the present temperature T to control the increase or reduction of the printing speed until printing is determined to be terminated. If printing is to be terminated (S17: YES), all printing processes are terminated.

Next, temperature changes and printing speed will be described with reference to FIG. 5. A graph of a rising trend will be described first. At the start of printing, printing is executed at a printing speed of 40 mm per second, and if the present temperature T of the thermal head 15 reaches the first threshold T1 of 53 degrees, the printing speed is controlled to become 20 mm per second. Next, when the temperature then tends to drop upon performing this printing speed control, the printing speed is changed to be 40 mm per second only at a point the present temperature T of the thermal head 15 has reached the second threshold T2 of 48 degrees as illustrated in the graph of a dropping trend. As shown in FIG. 5, because the printing speed changing thresholds are different for cases in which the temperature is rising and dropping, frequent switching of the printing speed when the temperature is in the vicinity of a threshold is reduced.

A tape printing apparatus 1, which is a best mode for embodying the printing apparatus according to a second exemplary embodiment of the invention, will be described. Because the mechanical structures and electric arrangements of the tape printing apparatus 1 are identical to those of the first exemplary embodiment of the invention, descriptions thereof will be omitted.

Figure 6:
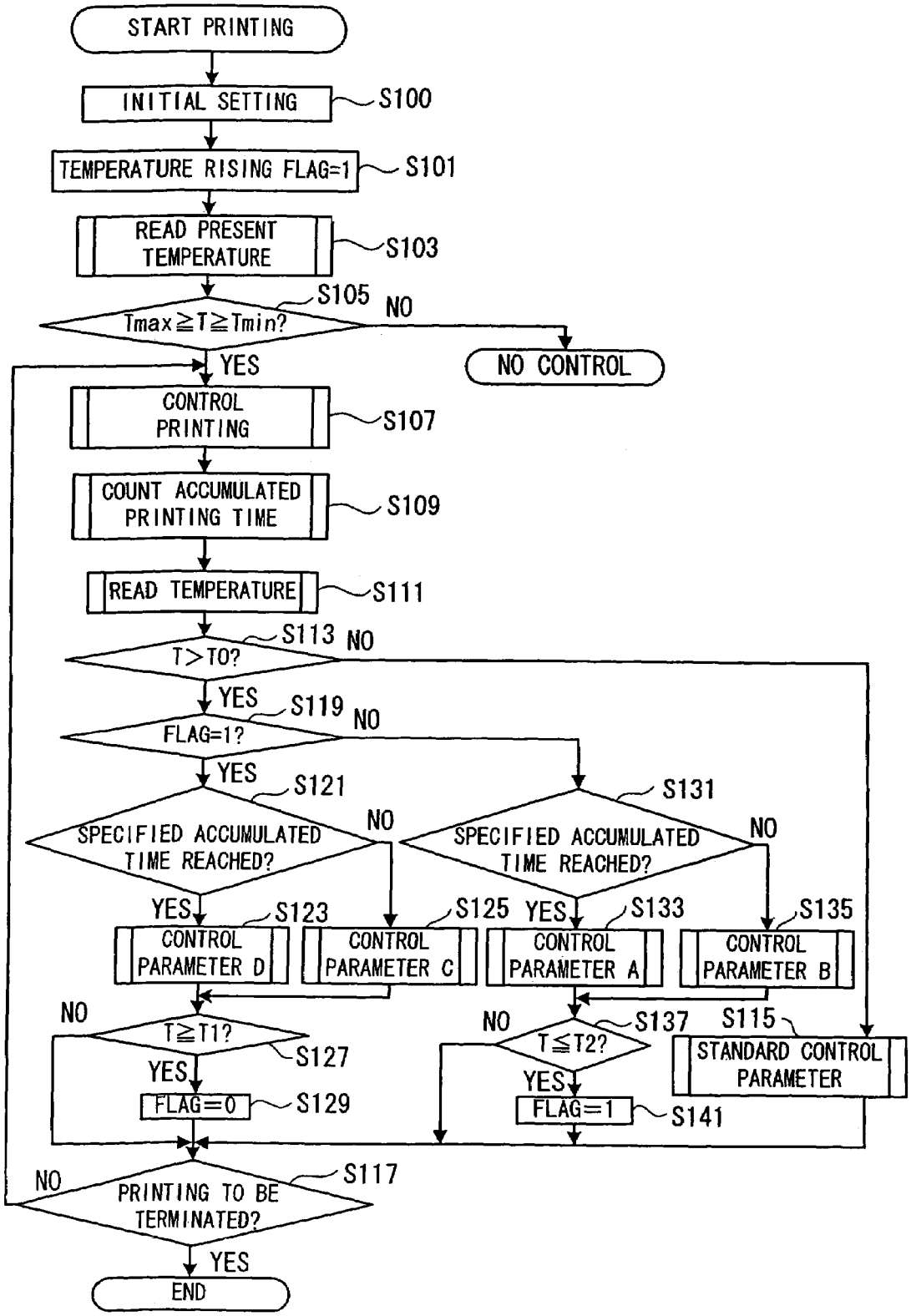
FIG. 6 is a flowchart that illustrates changing a duty ratio according to the exemplary embodiment of the invention.

Duty ratio changing processes when performing printing will be explained with reference to FIGS. 6 to 11. FIG. 6 is a flowchart that illustrates a duty ratio changing processes. FIGS. 7 to 11 are setting tables (parameter tables) of the duty ratios stored in the ROM 55. The duty ratios illustrate applying time of a driving pulse that is to be applied to the heating elements as proportions, and is a parameter of print energy. FIG. 7 is a schematic view illustrating a standard control parameter table, FIG. 8 is a schematic view illustrating a control parameter table when the temperature is dropping (hereinafter referred to as "parameter A"), FIG. 9 is a schematic view illustrating a control parameter table when the temperature is dropping (hereinafter referred to as "parameter B"), FIG. 10 is a schematic view illustrating a control parameter table when the temperature is rising (hereinafter referred to as "parameter C") and FIG. 11 is a schematic view illustrating a control parameter table when the temperature is rising (hereinafter referred to as "parameter D"). In these parameter tables, the duty ratios are defined as percentages depending on the temperature T. The applying time of the driving pulse is determined by the duty ratio.

When compared with the standard control parameter as illustrated in FIG. 7, the parameter A in FIG. 8 and the parameter B in FIG. 9 are such that the ratios of the applying time of the driving pulse to be applied to the heating elements are smaller irrespective of the peripheral temperature. In other words, the applying times are shorter. When the print energy is set in accordance with the parameter A in FIG. 8 and the parameter B in FIG. 9, the amount of cooling of the heating elements will be reduced so that the temperature of the thermal head 15 tends to drop.

In FIGS. 8 and 9, the ratio of the applying time of the driving pulse to be applied to the heating elements of the parameter A in FIG. 8 is smaller than that of parameter B in FIG. 9. Accordingly, when the print energy is set in accordance with the parameter A in FIG. 8, the degree at which the temperature of the thermal head 15 drops will be larger than that when the print energy is set in accordance with the parameter B in FIG. 9.

When compared with the standard control parameter as illustrated in FIG. 7, the parameter C in FIG. 10 and the parameter D in FIG. 11 are such that the ratios of the applying time of the driving pulse to be applied to the heating elements are larger. In other words, the applying times are longer. However, when the present temperature T of the thermal head 15 is high, more particularly, when the temperature has exceeded 62 degrees in case of the parameter C in FIG. 10, and when it has exceeded 59 degrees in case of the parameter D in FIG. 1, the duty ratio is set to be identical to that of the standard control parameter. Accordingly, when the print energy is set in accordance with the parameter C in FIG. 10 and the parameter D in FIG. 11, the amount of cooling of the heating elements will be increased so that the temperature of the thermal head 15 tends to rise.

In FIGS. 10 and 11 the ratio of the applying time of the driving pulse to be applied to the heating elements of the parameter C in FIG. 10 is larger than that of the parameter D in FIG. 11. Accordingly, when the print energy is set in accordance with the parameter C in FIG. 10, the degree at which the temperature of the thermal head 15 rises will be larger than that when the print energy is set in accordance with the parameter D in FIG. 11.

The duty ratio changing process will be described with reference to FIG. 6. As illustrated in FIG. 6, an initial setting (S100) is set to be the standard control parameter table as illustrated in FIG. 7. The temperature rising flag F is then set to 1 ((S101) if the temperature of the thermal head 15 is rising and F is set to 0 if the temperature of the thermal head 15 is dropping. After switching the power ON, the temperature of the thermal head 15 is gradually raised through the applied voltage so that 1 is set as the initial value in step S101. The temperature of the thermal head 15 is read by the thermistor 41 via the temperature detecting circuit 42 (S103). Next, whether the read present temperature T is within a specified range between a lower temperature Tmin and an upper temperature Tmax (S105) is determined. If the read present temperature T is not within the specified range (S105: NO), error is judged so no control is performed. If the read present temperature T is within the specified range (S105: YES), a duty ratio corresponding to the present temperature T in the standard control parameter table (See FIG. 7) that has been initially set in S100 is used to perform normal print control corresponding to one line to execute printing (S107).

Next, the accumulated number of printing times as obtained so far is counted (S109). The accumulated number of printing times is correlated to the temperature increase (thermal storage) of the thermal head 15 so that this information can also be considered when changing the duty ratio so that more accurate control is possible. In addition to accumulating the number of printing times, it is also possible to accumulate a number of printed dots or to accumulate a number of printed lines as information related to the thermal storage so such information can be considered when changing the duty ratio. The duty ratio may be structured so as to incorporate all counted values or to select one of the counted values.

The temperature T of the thermal head 15 read by the thermistor 41 is obtained via the temperature detecting circuit 42 (S111). Next, whether the read present temperature T of the thermal head 15 has exceeded the standard threshold TO is determined (S113). If the standard threshold TO is not exceeded (S113: NO), a parameter that determines the print energy is set to the standard control parameter table as illustrated in FIG. 7 (S115). Then whether printing is to be terminated is determined (S117). If printing is not to be terminated yet (S117: NO), the operation returns to step S107, and the print energy is determined in accordance with a duty ratio of the standard control parameter table as set in step S115 to perform print control corresponding to one line (S107). Steps S107 to S117 are repeated until the read present temperature T of the thermal head 15 has exceeded the standard threshold TO.

If the present temperature T exceeds the standard threshold TO (S113: YES), whether the temperature rising flag F is set to 1 is determined. That is, whether the temperature of the thermal head 15 is presently rising (S119). If F=1 is satisfied, that is, if the temperature is rising (S119: YES), whether the accumulated number of printing times as counted in step S109 has reached a default number of times is determined (S121). If the accumulated number of printing times has reached the default number (S121: YES), the thermal storage has progressed and the control parameter D as illustrated in FIG. 8 is set as the parameter to determine the print energy (duty ratio) (S123).

On the other hand, if the accumulated number of printing times has not reached the default number (S121: NO), the control parameter C as illustrated in FIG. 9 is set as the parameter to determine the print energy (duty ratio) (S125).

Irrespective of the set control parameter, whether the present temperature T that has been read in step S111 has reached a first threshold T1 is determined (S127). Here, the first threshold T1 is a parameter (duty ratio) switching temperature used when the temperature is rising and may be set to, for instance, 53 degrees. If the present temperature T has not exceeded the first threshold T1 yet (S127: NO), whether printing is to be terminated is determined (S117). If printing is not to be terminated yet (S117: NO), the operation returns to step S107, determines the print energy in accordance with the set control parameter C or D and performs print control corresponding to one line (S107). Steps S107 to S113, S119 to S127 and S117 are repeated until the read present temperature T of the thermal head 15 has reached the first threshold T1 (S127).

If the present temperature T has reached the first threshold T1 (S127: YES), control is performed to change the parameter and make the temperature drop by setting the temperature rising flag F to 0 (S129). Then whether printing is to be terminated is determined (S117). If printing is not to be terminated yet (S117: NO), the operation returns to step S107, determines the print energy in accordance with the set control parameter C or D and performs print control corresponding to one line (S107).

Next, the later routines describe when the temperature T is dropping (S119: NO) because the temperature rising flag has been set to 0 in step S129. Whether the accumulated number of printing times as counted in step S109 has reached the default number is determined (S131). If the accumulated number of printing times has reached the default number (S131: YES), the thermal storage has progressed and the control parameter A as illustrated in FIG. 8 is set as the parameter to determine the print energy (duty ratio) (S133).

On the other hand, if the accumulated number of printing times has not reached the default number (S131: NO), the control parameter B as illustrated in FIG. 9 is set as the parameter to determine the print energy (duty ratio) (S135).

Irrespective of the set control parameter, whether the present temperature T that has been read in step S111 has reached a second threshold T2 is determined (S137). Here, the second threshold T2 is a parameter (duty ratio) switching temperature used when the temperature is dropping and may be set to, for instance, 47 degrees. If the present temperature T has not reached the second threshold T2 (S137: NO), whether printing is to be terminated is determined (S117). If printing is not to be terminated yet (S117: NO), the operation returns to step S107, determines the print energy in accordance with the set control parameter A or B and performs print control corresponding to one line (S107). Steps S107 to S113, S119, S131 to S137 and S117 are repeated until the read present temperature T of the thermal head 15 has reached the second threshold T2.

If the present temperature T has reached the second threshold T2 (S137: YES), control is performed to change the parameter and make the temperature rise by setting the temperature rising flag F to 1 (S141). Then, whether printing is to be terminated is determined (S117). If printing is not to be terminated yet (S117: NO), the operation returns to step S107, determines the print energy in accordance with the set control parameter A or B and performs print control corresponding to one line (S107).

The above processes are repeatedly executed in which the temperature is read and the thresholds that meet rising and dropping vectors of the temperature (temperature rising flag) are compared with the present temperature to determine a parameter table (duty ratio) to determine the print energy until printing is to be terminated. If printing is to be terminated (S117: YES), all printing processes are terminated.

As explained so far, because parameter tables (duty ratios) are set and changed to determine the print energy by using two thresholds, the parameters (duty ratios) will not be frequently switched in the vicinity of the threshold so that a suitable printing quality may be maintained.

The invention is applicable to various thermal type printing apparatuses that require temperature control.

In the exemplary embodiment, a controller (CPU 52) preferably is implemented using a suitably programmed general purpose computer, e.g., a microprocessor, microcontroller or other processor device (CPU or MPU). It will be appreciated by those skilled in the art, that the controller can also be implemented as a single special purpose integrated circuit (e.g., ASIC) having a main or central processor section providing overall, system-level control, and separate sections dedicated to performing various different specific computations, functions and other processes under control of the central processor section. The controller can also be implemented using a plurality of separate dedicated or programmable integrated or other electronic circuits or devices such as hardwired electronic or logic circuits such as discrete element circuits, or programmable logic devices such as PLDs, PLAs, PALs and the like. The controller can also be implemented using a suitably programmed general purpose computer in conjunction with one or more peripheral (e.g., integrated circuit) data and signal processing devices. Further, any device or assembly of devices on which a finite state machine capable of implementing the described procedures can be used as the controller of the invention.

While the invention has been described with reference to exemplary embodiments, it is to be understood that the invention is not limited to the exemplary embodiments or constructions. While the various elements of the exemplary embodiments are shown in various combinations and configurations, which are exemplary, other combinations and configurations, including more, less or only a single element, are also within the spirit and scope of the invention.

What is claimed is:

1. A printing apparatus, comprising:

a thermal head;

a measurement device that measures a temperature of the thermal head; and a controller that:

controls a printing speed on the basis of the measured temperature as measured by the measurement device, determines whether the measured temperature of the thermal head is rising or dropping, compares a preliminarily determined first threshold value with the measured temperature when the temperature is rising, compares a preliminarily determined second threshold value with the measured temperature when the temperature is dropping, controls printing by reducing the printing speed when the measured temperature is greater than the first threshold value, and controls printing by raising the printing speed when the measured temperature is less than the second threshold value.

2. The printing apparatus according to claim 1, wherein the first threshold value is larger than the second threshold value.

3. A printing apparatus, comprising a thermal head including a plurality of heating elements;

a pulse applying circuit that applies driving pulses to the heating elements on the basis of a preliminary set duty ratio;

a measurement device that measures a temperature of the thermal head; and a controller that:

determines whether the temperature of the thermal head is rising or dropping, changes the duty ratio on the basis of the measured temperature, compares a preliminarily determined first threshold value with the measured temperature when the temperature is rising, and compares a preliminarily determined second threshold value with the measured temperature when the temperature is dropping, wherein the controller changes a duty ratio when the compared measured temperature is greater than the first threshold value and when the compared measured temperature is less than the second threshold value.

4. The printing apparatus according to claim 3, wherein the controller counts an accumulated time from a start of printing, and changes, when the accumulated time has exceeded a preliminarily determined third threshold value, the duty ratio to a duty ratio that is different from a case in which the third threshold value is not exceeded.

5. The printing apparatus according to claim 4, wherein the controller counts an accumulated number of printed dots from the start of printing, and changes, when the accumulated number of printed dots has exceeded the preliminarily determined third threshold value, the duty ratio to a duty ratio that is different from the case in which the third threshold value is not exceeded.

6. The printing apparatus according to claim 5, wherein the controller counts an accumulated number of printed lines from the start of printing, and changes, when the accumulated number of printed lines has exceeded the preliminarily determined third threshold value, the duty ratio to a duty ratio that is different from the case in which the third threshold value is not exceeded.

7. The printing apparatus according to claim 4, wherein the controller counts an accumulated number of printed lines from the start of printing, and changes, when the accumulated number of printed dots has exceeded the preliminarily determined third threshold value, the duty ratio to a duty ratio that is different from the case in which the third threshold value is not exceeded.

8. The printing apparatus according to claim 4, wherein the first threshold value is larger than the second threshold value.

9. The printing apparatus according to claim 3, wherein the controller counts an accumulated number of printed dots from a start of printing, and changes, when the accumulated number of printed dots has exceeded a preliminarily determined third threshold value, the duty ratio to a duty ratio that is different from a case in which the third threshold value is not exceeded.

10. The printing apparatus according to claim 9, wherein the controller counts an accumulated number of printed lines from the start of printing, and changes, when the accumulated number of printed lines has exceeded the preliminarily determined third threshold value, the duty ratio to a duty ratio that is different from the case in which the third threshold value is not exceeded.

11. The printing apparatus according to claim 9, wherein the first threshold value is larger than the second threshold value.

12. The printing apparatus according to claim 3, wherein the controller counts an accumulated number of printed lines from a start of printing, and changes, when the accumulated number of printed lines has exceeded a preliminarily determined third threshold value, the duty ratio to a duty ratio that is different from a case in which the third threshold value is not exceeded.

13. The printing apparatus according to claim 12, wherein the controller counts an accumulated number of printed dots from the start of printing, and changes, when the accumulated number of printed dots has exceeded the preliminarily determined third threshold value, the duty ratio to a duty ratio that is different from the case in which the third threshold value is not exceeded.

14. The printing apparatus according to claim 12, wherein the first threshold value is larger than the second threshold value.

15. The printing apparatus according to claim 3, wherein the first threshold value is larger than the second threshold value.

16. A method of controlling a printing apparatus having a thermal head, the method comprising:

measuring a temperature of a thermal head;

determining whether the temperature of the thermal head is rising or dropping;

comparing a preliminarily determined first threshold value with the measured temperature when the temperature is rising;

comparing a preliminarily determined second threshold value with the measured temperature when the temperature is dropping;

controlling printing by reducing the printing speed when the compared measured temperature is greater than the first threshold value; and controlling printing by raising the printing speed when the compared measured temperature is less than the second threshold value.

17. The method according to claim 16, wherein the first threshold value is larger than the second threshold value.

18. A method of controlling a printing apparatus having a thermal head including a plurality of heating elements, the method comprising:

measuring the temperature of the thermal head;

determining whether the temperature of the thermal head is rising or dropping;

changing a duty ratio on the basis of the measured temperature;

comparing a preliminarily determined first threshold value with the measured temperature when the temperature is rising;

comparing a preliminarily determined second threshold value with the measured temperature when the temperature is dropping;

changing the duty ratio when the compared measured temperature is greater than the first threshold value; and changing the duty ratio when the measured temperature is less than the second threshold value.

19. The method according to claim 18, wherein further comprising:

counting an accumulated time from a start of printing, and changing, when the accumulated time has exceeded a preliminarily determined third threshold value, the duty ratio to a duty ratio that is different from a case in which the third threshold value is not exceeded.

20. The method according to claim 19, further comprising:

counting an accumulated number of printed dots from the start of printing;

and changing, when the accumulated number of printed dots has exceeded the preliminarily determined third threshold value, the duty ratio to a duty ratio that is different from the case in which the third threshold value is not exceeded.

21. The method according to claim 20, further comprising:

counting an accumulated number of printed lines from the start of printing, and changing, when the accumulated number of printed lines has exceeded the preliminarily determined third threshold value, the duty ratio to a duty ratio that is different from the case in which the third threshold value is not exceeded.

22. The method according to claim 19, further comprising:

counting an accumulated number of printed lines from a start of printing, and changing, when the accumulated number of printed lines has exceeded the preliminarily determined third threshold value, the duty ratio to a duty ratio that is different from the case in which the third threshold value is not exceeded.

23. The method according to claim 19, wherein the first threshold value is larger than the second threshold value.

24. The method according to claim 18, further comprising:

counting an accumulated number of printed dots from a start of printing; and changing, when the accumulated number of printed dots has exceeded a preliminarily determined third threshold value, the duty ratio to a duty ratio that is different from a case in which the third threshold value is not exceeded.

25. The method according to claim 24, further comprising:

counting an accumulated number of printed lines from the start of printing, and changing, when the accumulated number of printed lines has exceeded the preliminarily determined third threshold value, the duty ratio to a duty ratio that is different from the case in which the third threshold value is not exceeded.

26. The method according to claim 24, wherein the first threshold value is larger than the second threshold value.

27. The method according to claim 18, further comprising:

counting an accumulated number of printed lines from a start of printing; and changing, when the accumulated number of printed lines has exceeded a preliminarily determined third threshold value, the duty ratio to a duty ratio that is different from a case in which the third threshold value is not exceeded.

28. The method according to claim 27, further comprising:

counting an accumulated number of printed dots from the start of printing, and changing, when the accumulated number of printed dots has exceeded a preliminarily determined third threshold value, the duty ratio to a duty ratio that is different from the case in which the third threshold value is not exceeded.

29. The method according to claim 27, wherein the first threshold value is larger than the second threshold value.

30. The method according to claim 18, wherein the first threshold value is larger than the second threshold value.

31. A printing apparatus, comprising:

a thermal head;

a measurement device that measures a temperature of the thermal head; and a controller that:

controls a first operating condition on the basis of the measured temperature as measured by the measurement device, determines whether the measured temperature of the thermal head is rising or dropping, compares a preliminarily determined first threshold value with the measured temperature when the temperature is rising, compares a preliminarily determined second threshold value with the measured temperature when the temperature is dropping, controls printing by reducing the first operating condition when the measured temperature is greater than the first threshold value, and controls printing by raising the first operating condition when the measured temperature is less than the second threshold value, wherein the controller changes a second operating condition when the compared measured temperature is greater than the first threshold value and when the compared measured temperature is less than the second threshold value.

* * * * *